US006543955B2

(12) United States Patent
Conaway et al.

(10) Patent No.: US 6,543,955 B2
(45) Date of Patent: Apr. 8, 2003

(54) MULTI-DEGREE OF FREEDOM ELASTOMERIC JOINT

(75) Inventors: Jerry Lee Conaway, Edinboro, PA (US); William Anthony Kurtzhals, Erie, PA (US)

(73) Assignee: General Electric Company

( * ) Notice: Subject to any disclaimer, the term of this patent is extended or adjusted under 35 U.S.C. 154(b) by 88 days.

(21) Appl. No.: 09/768,835

(22) Filed: Jan. 24, 2001

(65) Prior Publication Data

US 2002/0098034 A1 Jul. 25, 2002

(51) Int. Cl.[7] ..... B61F 5/00; F16D 3/52

(52) U.S. Cl. ..... 403/57; 105/220; 105/225.05; 464/87; 464/113

(58) Field of Search ..... 403/225, 226, 403/57; 105/220, 221.1, 224.05, 224.1; 465/87, 903, 92, 112, 113

(56) References Cited

U.S. PATENT DOCUMENTS

| | | | | | |
|---|---|---|---|---|---|
| 3,095,714 | A | * | 7/1963 | Schlotmann | 464/80 |
| 3,224,224 | A | * | 12/1965 | Kudriavetz, Jr. | 464/87 |
| 4,050,266 | A | | 9/1977 | Bergman | |
| 4,194,372 | A | | 3/1980 | Hannibal | |
| 4,229,951 | A | * | 10/1980 | Jedlicka | 464/87 |
| 4,413,569 | A | | 11/1983 | Mulcahy | |
| 4,416,203 | A | | 11/1983 | Sherrick | |
| 4,430,065 | A | | 2/1984 | Peterson | |
| 5,237,933 | A | | 8/1993 | Bucksbee | |
| 5,295,670 | A | * | 3/1994 | Tsukamoto et al. | 267/140.5 |
| 6,006,674 | A | | 12/1999 | Ahmadian et al. | |

* cited by examiner

*Primary Examiner*—Robert J. Sandy
(74) *Attorney, Agent, or Firm*—Carl Rowold, Esq.; Enrique J. Mora, Esq.; Beusse, Brownlee, Bowdoin & Wolter, PA

(57) ABSTRACT

An elastomeric joint (100) that comprises a wing plate (102) including a base plate (104) generally extending along a first axis and generally perpendicular to a second axis is provided. The wing plate further includes a mutually opposite first and second bushing-receiving bores (120) co-axially aligned relative to a third axis perpendicular to said first and second axes. A plurality of elastomeric shear pads (106) is affixed on mutually opposite sides of the base plate. The plurality of shear pads is stacked generally perpendicular to the second axis. Top and bottom elastomeric bushings (122) are received by said respective bushing-receiving bores. Each elastomeric bushing comprises a plurality of torsion pads (124) and includes a respective pin-receiving bore (128). Each of the shear pads and torsion pads comprises a plurality of alternating layers of resilient and nonextensible materials, wherein the shear pads are compressed to provide stiff opposition to forces along said second axis, while accommodating differential displacement along the first axis and/or along the third axis, and wherein said elastomeric bushings are compressed to enable pivotal movement about the third axis while providing stiff opposition to radial forces on the bushings.

19 Claims, 6 Drawing Sheets

MULTI-DEGREE OF FREEDOM ELASTOMERIC JOINT

BACKGROUND OF THE INVENTION

The present invention is generally related to mechanical coupling, and, more particularly, the present invention is related to elastomeric joints that may be configured to couple devices, such as steering linkages in railway vehicles.

In a railway vehicle, such as a locomotive, the vehicle body is mounted on a frame which in turn is mounted on a pair of longitudinally spaced apart multi-axle trucks having wheels which ride on the rails of a train track. The two trucks are typically identical, with each truck having typically two or three axles and a pair of wheels on opposite ends thereof. In an exemplary three axle diesel-electric locomotive, each axle further includes an integral electrical motor combination, or simply motor combo, for directly powering the wheels. The motor combos drive the wheels for propelling the locomotive either in forward or reverse directions utilizing inherent traction friction between the wheels and the rails. The locomotive, in turn, pulls or pushes a train of railway cars joined thereto. The trucks also include conventional brakes for stopping the locomotive again using the inherent traction friction between the wheels and the rails. Accordingly, traction loads must be carried between the axles and the frame during forward and reverse driving and braking operation. This is conventionally accomplished by suitably suspending the axles to the frame.

One important consideration in locomotive design is the ability of the axles to negotiate curves during operation. In a multi-axle truck, the leading axle negotiates a turn before the trailing axle which creates substantial lateral loading, e.g., steering loads, between the axles and the frame and affects efficient operation and longevity of the trucks. In order to accommodate typical problems associated with negotiating rail curves, self-steering trucks have been developed. Steering is accomplished by suitably interconnecting the leading and trailing axles so that the axles yaw in opposite directions to each other upon negotiating curves.

Axle suspension design is generally complex due to various mechanical considerations: the axles should be vertically suspended from the frame for accommodating vertical loads; the axles should be longitudinally constrained for carrying the forward and reverse traction loads to the frame; the axles should be also mounted for allowing self-steering yaw motion thereof in opposite angular directions between leading and trailing axles; and, the axles should be laterally constrained. Axle suspension in a three-axle truck may be further complicated since the leading and trailing end axles need to be angularly interconnected for self-steering, and the middle axle is independent from the leading and trailing end axles and is interposed longitudinally between such axles.

U.S. patent application No. 6,006,674, commonly assigned to the same assignee of the present invention, discloses an improved design over self-steering trucks that have undesirably included a large number of pivoting joints, which are typically made using conventional bearings or friction joints, and are thus susceptible to wear and fretting problems. It is desirable, however, to further improve the self-steering linkage by providing a multi-degree of freedom elastomeric joint that allows to further reduce the number of components subject to undesirable wear and still meet the complex mechanical constraints required by such self-steering linkage.

SUMMARY OF THE INVENTION

Generally speaking, the present invention fulfills the foregoing needs by providing in one aspect thereof, a multi-degree of freedom elastomeric joint that in fictionless engagement allows differential longitudinal and pivotal movement between adjoining ends of a pair of reaction arms used in a steering linkage of a railway truck.

In one exemplary embodiment, the joint comprises a wing plate that includes a base plate generally extending along a first axis and generally perpendicular to a second axis. The wing plate further includes a mutually opposite first and second bushing-receiving bores co-axially aligned relative to a third axis perpendicular to said first and second axes. A plurality of elastomeric shear pads is affixed on mutually opposite sides of the base plate. The plurality of shear pads is stacked generally perpendicular to the second axis. Top and bottom elastomeric bushings are received by said respective bushing-receiving bores. Each elastomeric bushing comprises a plurality of torsion pads and includes a respective pin-receiving bore. Each of the shear pads and torsion pads comprises a plurality of alternating layers of resilient and nonextensible materials, wherein the shear pads are compressed, e.g., compressively preloaded during installation, to provide stiff opposition to forces along said second axis, while accommodating differential displacement along the first axis and/or along the third axis by providing relatively low stiffness along such first and/or second axes, and wherein the torsion pads are compressed, e.g., compressively preloaded during installation, to enable pivotal movement about the third axis by providing relatively low torsional stiffness about that third axis while providing stiff opposition to radial forces on the torsion pads.

The present invention further fulfils the forgoing needs by providing in another aspect thereof, a method of assembling an elastomeric joint. The method allows for providing a wing plate that includes a base plate generally extending along a first axis and generally perpendicular to a second axis. The wing plate further provides mutually opposite first and second bushing-receiving bores co-axially aligned relative to a third axis perpendicular to the first and second axes. The method allows for affixing a plurality of elastomeric shear pads on mutually opposite sides of the base plate. The plurality of shear pads is stacked generally perpendicular to the second axis. A fitting step allows for interferingly fitting top and bottom elastomeric bushings in the respective bushing-receiving bores. Each elastomeric bushing comprises a plurality of torsion pads and includes a respective pin-receiving bore. Each of the shear pads and torsion pads comprises a plurality of alternating layers of resilient and nonextensible materials. Respective preloading steps respectively allow for compressively preloading the shear pads to provide stiff opposition to forces along the second axis, while accommodating differential displacement along the first axis and/or along the third axis, and for compressively preloading the torsion pads to enable pivotal movement about the third axis while providing stiff opposition to radial forces on the torsion pads.

Figure 1:
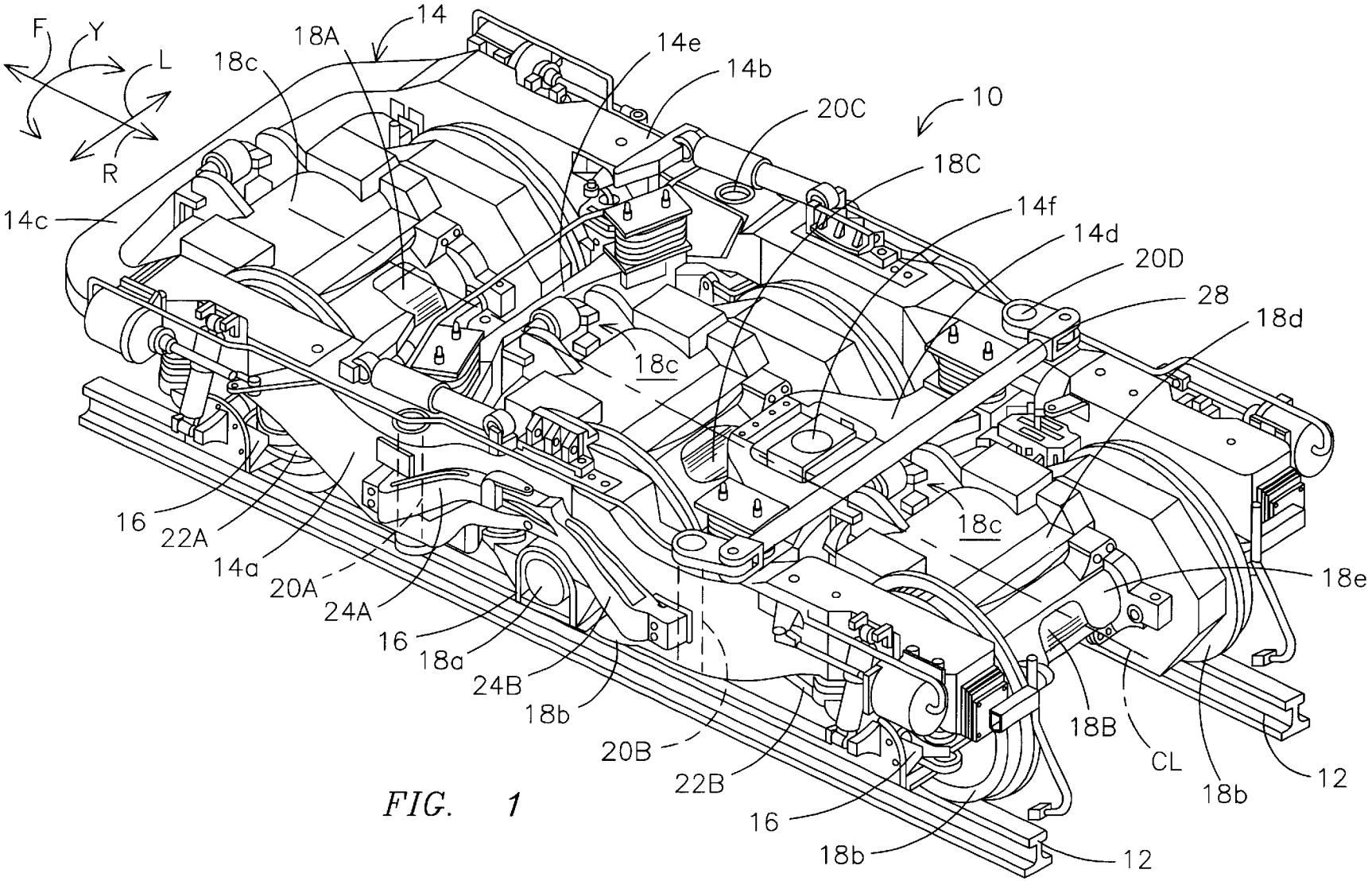
FIG. 1 is an isometric view of an exemplary three-axle locomotive truck including a self-steering linkage that may benefit from an elastomeric joint in accordance with one aspect of the present invention.

Before any embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

Illustrated schematically in FIG. 1 is an exemplary railway truck 10 that may benefit from the teachings of the present invention. The truck 10 is one of two trucks which are configured for conventionally supporting a locomotive body (not shown) for powering a train of railway cars (also not shown). The truck 10 rides a pair of conventional rails 12 of a train track which includes various portions which are either straight or curved.

The trucks 10 are identical to each other and are typically mounted to the locomotive body in opposite orientations, with the following description of an exemplary truck 10 also applying to the other truck as well. The truck 10 includes a truck frame 14 having a longitudinal centerline axis CL. The frame 14 includes a pair of first and second laterally spaced apart and generally parallel side frames 14*a* and 14*b*, and three longitudinally spaced apart transoms 14*c*, 14*d* and 14*e* extending laterally between and integrally joined to the side frames 14*a*, 14*b*. The entire frame 14 is generally made as a single casting, with the first transom 14*c* being joined to longitudinal ends of the side frames for closing the truck frame 14 at one end, the second transom 14*d* being spaced longitudinally inwardly from the opposite ends of the side frame for leaving open the opposite ends of the frame 14, and the third or middle transom 14*e* being spaced between the first and second transoms 14*c*, 14*d* in a substantially conventional configuration. The truck frame 14 itself may include open C-sections or closed box sections.

As indicated above, the truck 10 is one of two identical trucks which support the locomotive body, with the locomotive being used for driving a train of railway cars attached thereto. The considerable loads for driving the railway cars is conventionally carried through the truck frame 14 at a suitable trunnion 14*f* disposed in the center of the second transom 14*d*. A plurality of identical journal boxes 16 are resiliently suspended from the side frames 14*a*, 14*b* to in turn support a plurality of longitudinally spaced apart identical axles designated by the prefix 18 extending laterally between the side frames and having opposite ends rotatably mounted in respective ones of the journal boxes 16. In the exemplary embodiment illustrated in FIG. 1, the truck 10 is a three-axle truck with the three axles being identical to each other except for placement in the frame 14. The axles are therefore identified generally by the reference numeral 18 and specifically with a corresponding uppercase suffix, with first and second end axles 18A and 18B being disposed at longitudinally opposite ends of the frame 14 adjacent to the respective first and second transoms 14*c* and 14*d*, and the third or middle axle 18C being disposed longitudinally therebetween and adjacent to the third or middle transom 14*e* in a conventional configuration. The axles 18 may each be removably joined to the respective journal boxes 16.

The axles 18 themselves are conventional, with each axle including an axle bearing assembly, or simply bearing 18*a* at both opposite ends of the axle which are captured in respective ones of the journal boxes 16. The axle bearing 18*a* is also conventional and typically includes a pair of tapered roller bearings for accommodating both radial and axial thrust loads, and which are mounted in a suitable annular bearing housing. Although modern trains typically use roller bearings instead of plain journal bearings, the bearing boxes which suspend the axles to the frame are typically still referred to as journal boxes.

Disposed immediately inboard of the end axle bearings 18*a* are respective wheels 18*b* which are also conventional for supporting the frame 14 on the rails 12. In the exemplary embodiment illustrated in FIG. 1, the locomotive is a diesel-electric locomotive which conventionally provides power to conventional electrical motor 18*c* which are conventionally joined to respective ones of the axles 18 in a combination therewith typically called a motor combo. By suitably powering the motor combos 18*c*, the respective three axles 18 and wheels 18*b* thereon are powered for driving the truck 10 in either of two opposite longitudinal directions represented for example by a forward direction F and a reverse direction R relative to the centerline axis CL. The forward and reverse directions are relative and may be interchanged with each other if desired.

Self-Steering Truck Linkage

As FIG. 1 indicates, the truck 10 includes various components arranged closely together in a compact arrangement to take relatively little space for self-steering linkage. The self-steering linkage includes various components which provide effective kinematic movements so that the end axles 18A, 18B yaw in opposite directions relative to each other when negotiating left or right curves on the rails 12. As shown in FIG. 1, the three axles 18 are disposed coplanar in a horizontal plane with lateral motion being designated by the double headed straight arrow L which represents side-to-side motion perpendicular to the frame centerline axis CL and the rails 12 in the horizontal plane, with yaw rotation being designated by the double headed curved arrow Y also in the same horizontal plane. Further, the self-steering linkage should also be effective for carrying the substantial traction loads between the-wheels 18*b* and the truck frame 14 in an efficient manner without compromising the self-steering ability between the end axles 18A, 18B. The traction loads are created by powering the motors 18*c* to drive the axles 18 and wheels joined thereto in either the forward or reverse directions, with additional traction loads also being created in either direction upon application of conventional brakes found in the truck 10.

Figure 2:
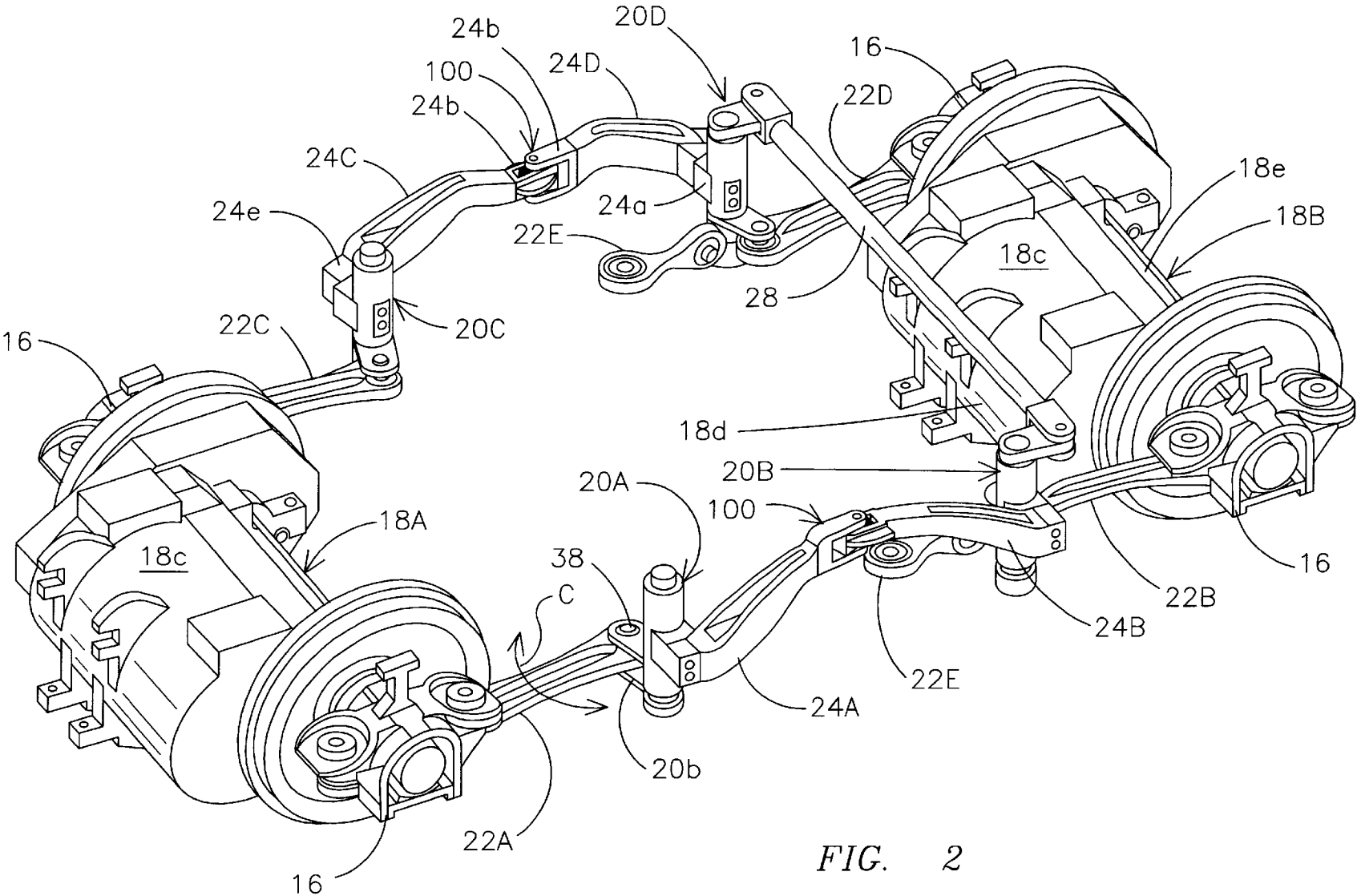
FIG. 2 is an isometric view of first and second axles and the self-steering linkage of FIG. 1 being removed from its mounting frame for clarity of illustration.

The self-steering linkage is illustrated in various levels of assembly in FIGS. 1–2. By way of illustration, the middle axle 18C illustrated in the exemplary embodiment of FIG. 1 is not subject to self-steering. Further, although self-steering is being described with respect to a three-axle truck 10, it may also be applied to a simpler two-axle truck since only the end axles would undergo self-steering and effect counter-yaw relative to each other when negotiating curves.

Referring to FIG. 2, the self-steering linkage includes a pair of longitudinally spaced apart bellcranks which are essentially identical to each other except for placement and orientation and are therefore generally referred with the reference prefix numeral 20, followed by an uppercase suffix to identify individually located ones of the bellcranks 20. A first pair of first and second bellcranks 20A and 20B are rotatably joined to the first side frame 14*a* (as shown in FIG. 1) longitudinally between the end axles 18A, 18B and described in more detail herein below. A second pair of third and fourth bellcranks 20C and 20D are rotatably joined to the second side frame 14*b* (as shown in FIG. 1) longitudinally between the end axles 18A, 18B and also described in more detail herein below. Since each of the bellcranks 20 are substantially identical the various components thereof are identified using the same lowercase reference numeral suffix.

Referring again to FIG. 2, respective pairs of traction links designated generally by the prefix 22 extend longitudinally along each of the side frames 14*a,* 14*b* (see FIG. 1) for carrying the substantial tension and compression traction loads between the journal boxes 16 and the truck frame 14. Individual end traction links 22A–D are pivotally joined between respective ones of the end journal boxes, 16 and the crank arms 20*b* for carrying tension and compression loads therebetween through a connecting cross link 28. As shown in FIG. 2, first, second, third, and fourth end traction links 22A, 22B, 22C, and 22D are respectively joined to the first, second, third, and fourth bellcranks 20A, 20B, 20C, 20D at the respective crank arms 20*b* thereof and to corresponding ones of the end journal boxes 16. The four end links 22A–D are preferably identical to each other.

Respective pairs of adjoining reaction arms designated generally by the prefix 24 extend longitudinally along each of the side frames 14*a,* 14*b* (see FIG. 1), with each reaction arm 24 being fixedly joined at one end to a respective one of the bellcranks 20, and overlapping each other in pairs at opposite ends thereof. As shown in FIG. 2, first, second, third, and fourth reaction arm 24A, 24B, 24C, and 24D are suitably fixedly joined to respective ones of the first, second, third and fourth bellcranks 20A–D at respective crankshafts 20*a* thereof.

As shown in FIG. 2, for example, each of the reaction arms 24 has longitudinally opposite proximal and distal ends 24*a* and 24*b,* with each proximal end 24*a* being suitably fixedly joined to a respective one of the crankshafts 20*a,* and the distal ends 24*b* adjoining each other in longitudinal overlap. The adjoining distal ends 24*b* of respective pairs of the reaction arms 24 are operatively joined together as described in more detail herein below for carrying lateral reaction loads independently between each of the reaction arms pairs 24A, 24B and 24C, 24D at each side frame 14*a,* 14*b* upon rotation of the crankshafts 20*a* while permitting differential longitudinal and pivotal movement between the adjoining distal ends 24*b*.

Figure 3:
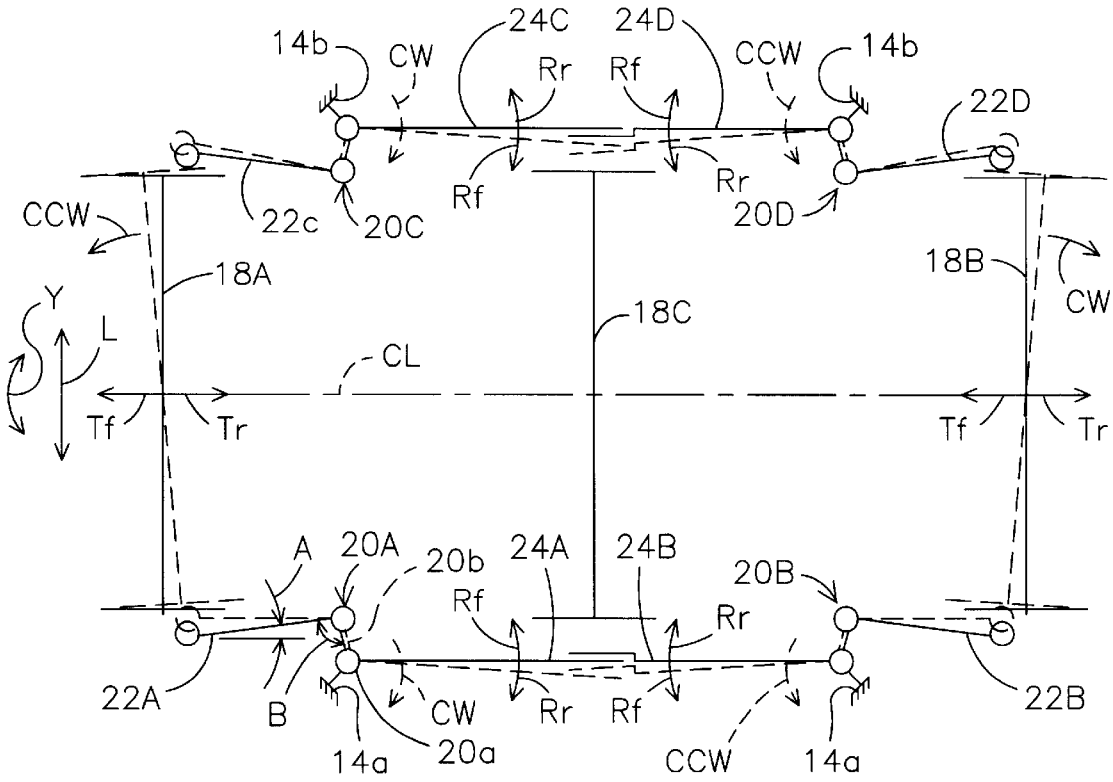
FIG. 3 is a schematic plan view of the truck frame illustrated in FIG. 1 showing exemplary kinematic effects that may be experienced by the steering linkage when the truck is travelling in a straight line, shown in solid line, and when negotiating a curve, shown in dashed line.

FIG. 3 illustrates schematically all four linkage subassemblies of corresponding bellcranks, traction links, and reaction arms mounted in the respective side frames 14*a,* 14*b* relative to the three axles 18A–C. FIG. 3 schematically represents operation of the self-steering linkage under straight forward and reverse traction loads designated Tf and Tr during drive or braking as shown in solid line, and during negotiation of a left curve for example, in dashed line, showing exaggerated relative displacements of the components. The forward and reverse traction loads are carried in turn through the end axles 18A, 18B, journal boxes 16 (not shown), traction links 22A–D, and the bellcranks 20A–D to respective side frames 14*a,b.* The bellcranks 20, traction links 22, and reaction arms 24 are symmetrically laterally disposed relative to the frame centerline axis CL, and symmetrically longitudinally disposed relative to the middle axis 18C.

The forward and reverse traction loads developed by the end axles 18A, 18B are carried directly into the side frames 14*a,b* through the respective bellcranks 20 joined thereto, with rotation of the bellcranks 20 being opposed or reacted by the cooperating adjoining reaction arms 24A, 24B and 24C, 24D. The forward traction force Tf at the first end axle 18A effects corresponding inboard directed reaction force Rf at the corresponding first and third reaction arms 24A, 24C joined thereto. The forward traction force Tf at the second end axle 18B effects outboard directed reaction force Rf on the corresponding second and fourth reaction arms 24B, 24D which opposes the inboard reaction forces from the adjoining first and third reaction arms 24A, 24C.

Under reverse traction loads Tr, corresponding oppositely directed reverse reaction loads Rr are effected at the adjoining pairs of reaction arms 24A,B and 24C,D. Accordingly, in one traction direction, e.g., forward traction Tf, the respective pairs of reaction arms are driven in opposite inboard and outboard directions toward each other, and in the opposite traction direction, e.g. the reverse traction force Tr, the adjoining reaction arms are similarly driven in opposite directions tending to separate apart the adjoining reaction arms. This symmetrical arrangement of the self-steering linkage ensures that the end axles 18A, 18B track straight relative to the frame centerline axis CL without yaw Y or lateral movement L. It also ensures that symmetric curving, i.e., same behavior in right-hand and left-hand curves, is obtained.

As will be appreciated by those skilled in the art, self-steering of the end axles 18A, 18B is efficiently effected as the truck negotiates either left or right curves, with the negotiating of a left curve being illustrated in dashed line in FIG. 3. As the first end axle 18A enters the left curve effected by the rails 12 shown in FIG. 1, the first axle 18A is permitted to undergo limited self-steering in the yaw direction Y, which is counterclockwise (CCW) in the example illustrated in FIG. 3. This yaw of the first axle 18A causes the corresponding ones of the bellcranks 20A, 20C on opposite sides of the frame to corotate together, e.g. clockwise (CW), which in turn corotates together the corresponding first and third reaction arms 24A, 24C joined thereto which cantilever to counterrotate together the adjoining second and fourth reaction arms 24B,D to counterrotate together the corresponding second and fourth bellcranks 20B, 20D joined thereto to counter-yaw the opposite second axle 18B in the clockwise direction.

Whereas the traction links 22 primarily operate in simple tension and compression, the reaction arms 24 primarily operate in lateral bending without significant longitudinal net tension or compression loading therein. The reaction aims 24 provide cantilever or pivot motion to pivot the respective bellcranks 20 for obtaining counter-yaw between the first and second axles 18A, 18B. In the left curve operation illustrated in dashed line in FIG. 3, both pairs of reaction arms 24 move to the left, with the first and second reaction arms 24A, 24B moving outboard, and the third and fourth reaction arms 24C, 24D moving inboard. For a right curve not illustrated in FIG. 3, the opposite movement occurs for yawing the first axle 18A in a clockwise direction, and counter-yawing the second axle 18B in the counter-clockwise direction.

The non-symmetrical rotational movement of the adjoining reaction arm pairs shown in dashed line in FIG. 3 during self-steering illustrates the multi-functional joint required between the distal ends thereof. Since each reaction arm 24 must rotate during self-steering operation, both differential longitudinal and pivotal movement between the adjoining distal ends is required. And, the joint must also effectively carry the required lateral reaction forces Rf and Rr between the adjoining reaction arm distal ends which are laterally driven together or apart as described in more detail later hereinbelow.

Figure 4:
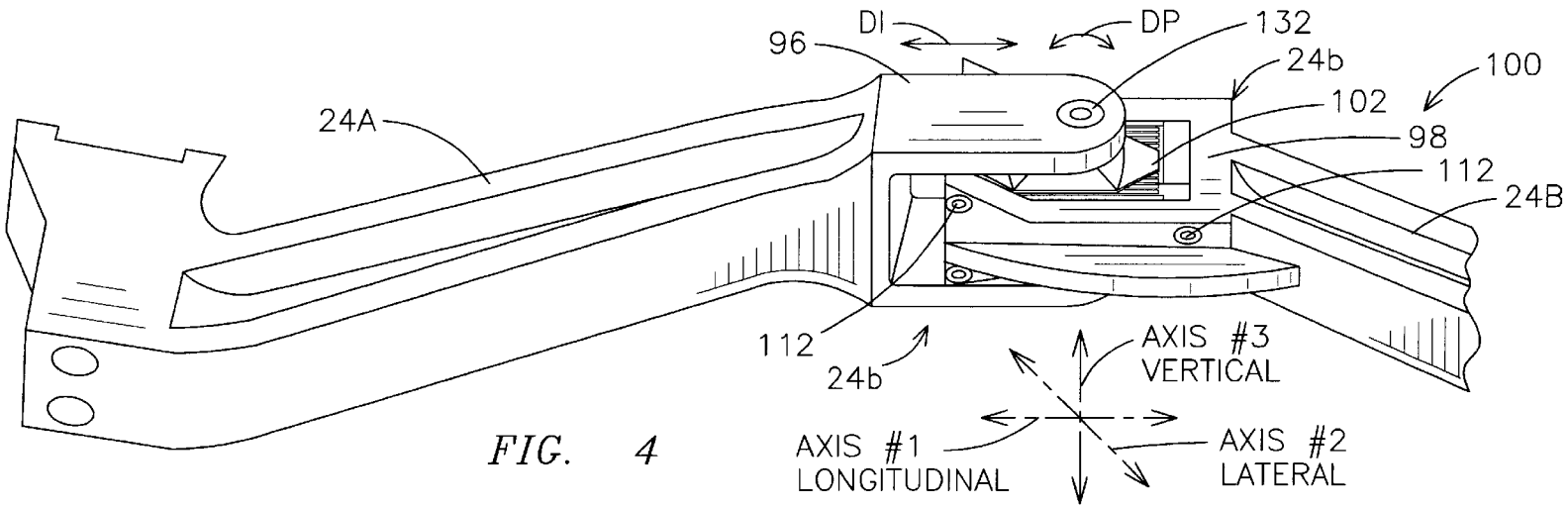
FIG. 4 is a generally side isometric view of the elastomeric joint of the present invention connected to respective adjoining ends of an exemplary pair of reaction arms of the steering linkage.

In accordance with one aspect of the present invention, a multi-degree of freedom elastomeric joint 100 is provided for operatively joining together each respective adjoining pair of reaction arms 24A, 24B and 24C, 24D for accommodating differential movement therebetween during operation, for effectively carrying the lateral reaction forces Rf and Rr and for providing pivotal motion without having to use a pin that rotates about a metallic bushing. The reaction arms and their assembly to joint 100 are illustrated in more particularity in FIGS. 4–6 wherein the first and second adjoining reaction arms 24A, and 24B are exemplarily illustrated, with the understanding that the third and fourth traction arms 24C, 24D are configured identically. As indicated above, and now referring to FIG. 4, the adjoining distal ends 24*b* of the reaction arms 24 must effectively carry the lateral reaction forces Rf and Rr therebetween which tend to bring together or separate the distal ends during operation. And, as the reaction arms 24 rotate inboard or outboard together during self-steering operation, the respective distal ends 24*b* thereof must accommodate differential longitudinal movement therebetween Dl and differential pivotal movement therebetween Dp. As shown in FIG. 4, in one exemplary embodiment, the distal end 24*b* of reaction arm 24A is configured as a two-prong fork 96 and the distal end 24*b* of reaction arm 24B is configured as a bracket 98 that is received by the two-prong fork.

Figure 8:
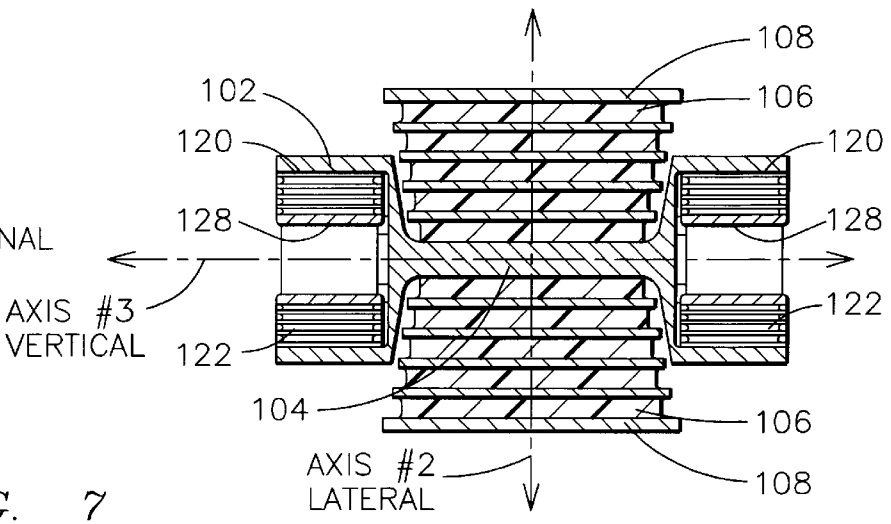
FIG. 8 is a view along line 8—8 in FIG. 7
Figure 7:
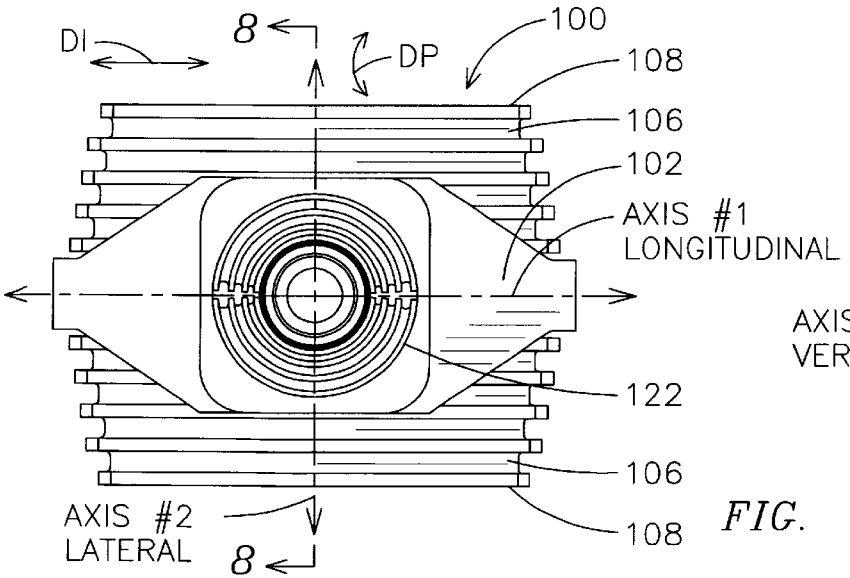
FIG. 7 is a top view of the elastomeric joint of FIG. 4 illustrating an exemplary elastomeric bushing therein.
Figure 5:
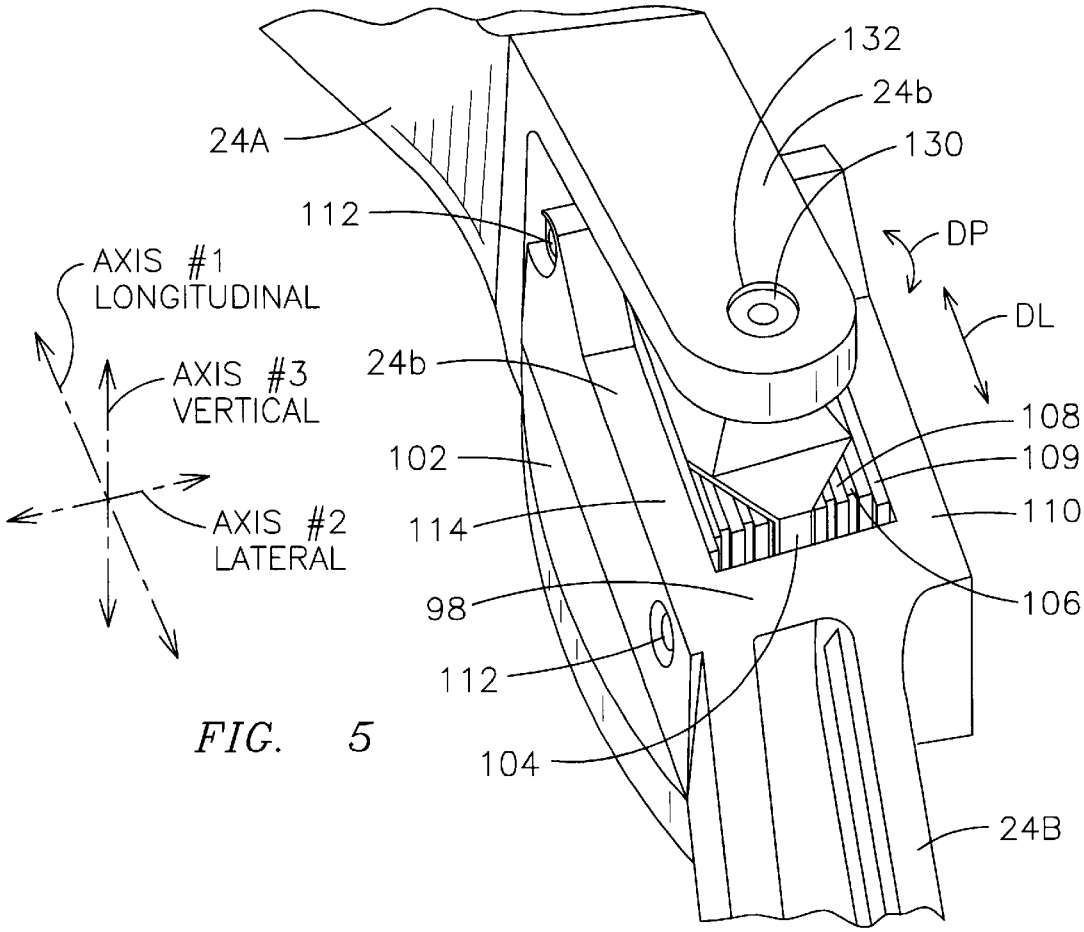
FIG. 5 is a generally top isometric view of the elastomeric joint shown in FIG. 4.

Accordingly, a joint 100 as illustrated in FIGS. 4–9 is provided for suitably joining the adjoining distal ends 24*b* of the reaction arms 24 for accomplishing these many objectives. The joint 100 in one exemplary embodiment comprises a multidegree of freedom elastomeric joint. A metal wing plate 102, as illustrated in various levels of details FIGS. 4–8, includes a centrally disposed base plate 104 (FIGS. 5 and 8) generally perpendicular to the lateral axis L and generally parallel relative to the longitudinal axis F-R. A plurality of elastomeric shear pads 106 (FIGS. 5 and 8) are fixedly joined to the opposite surfaces of the base plate 104. As shown in FIG. 8, the shear pads comprise a plurality of alternating layers of resilient material, e.g., natural or synthetic rubber, and nonextensible material, e.g., metal shims 108. A cover plate 110, as best shown in FIG. 5, is affixable to the bracket 98 by a plurality of fastener bolts 112, for example, for clamping and compressing the shear pads 106 stacked on the base plate 104 against a back section 114 of the bracket 98 for allowing the wing plate 102 to translate relative to the bracket 98 upon shearing of the pads 106 in the longitudinal direction generally parallel with the frame centerline axis.

Figure 9:
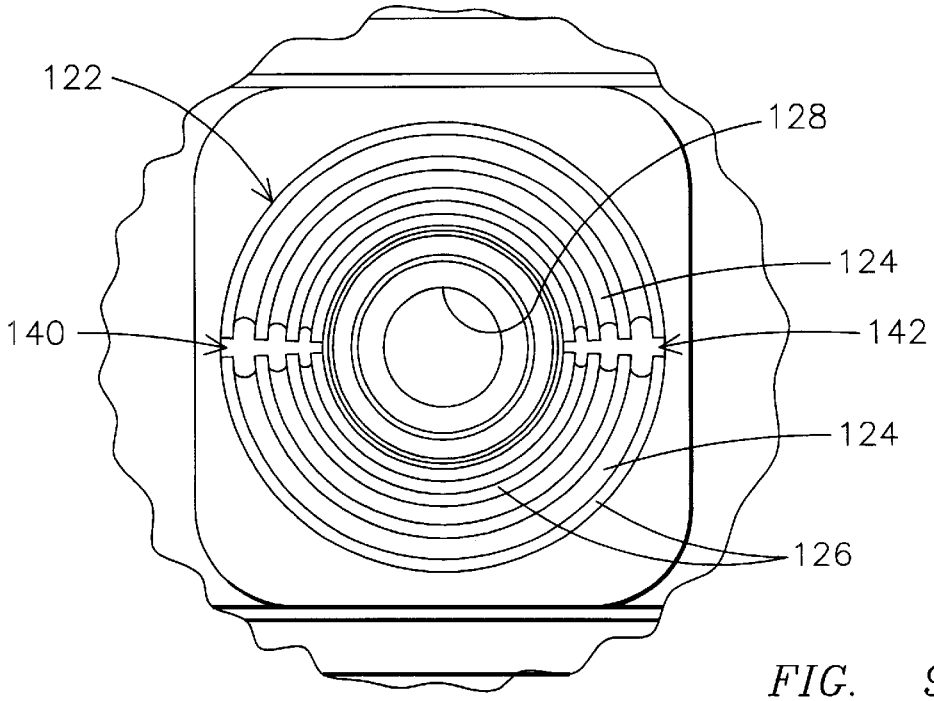
FIG. 9 illustrates further details regarding the elastomeric bushing of FIG. 7.
Figure 10:
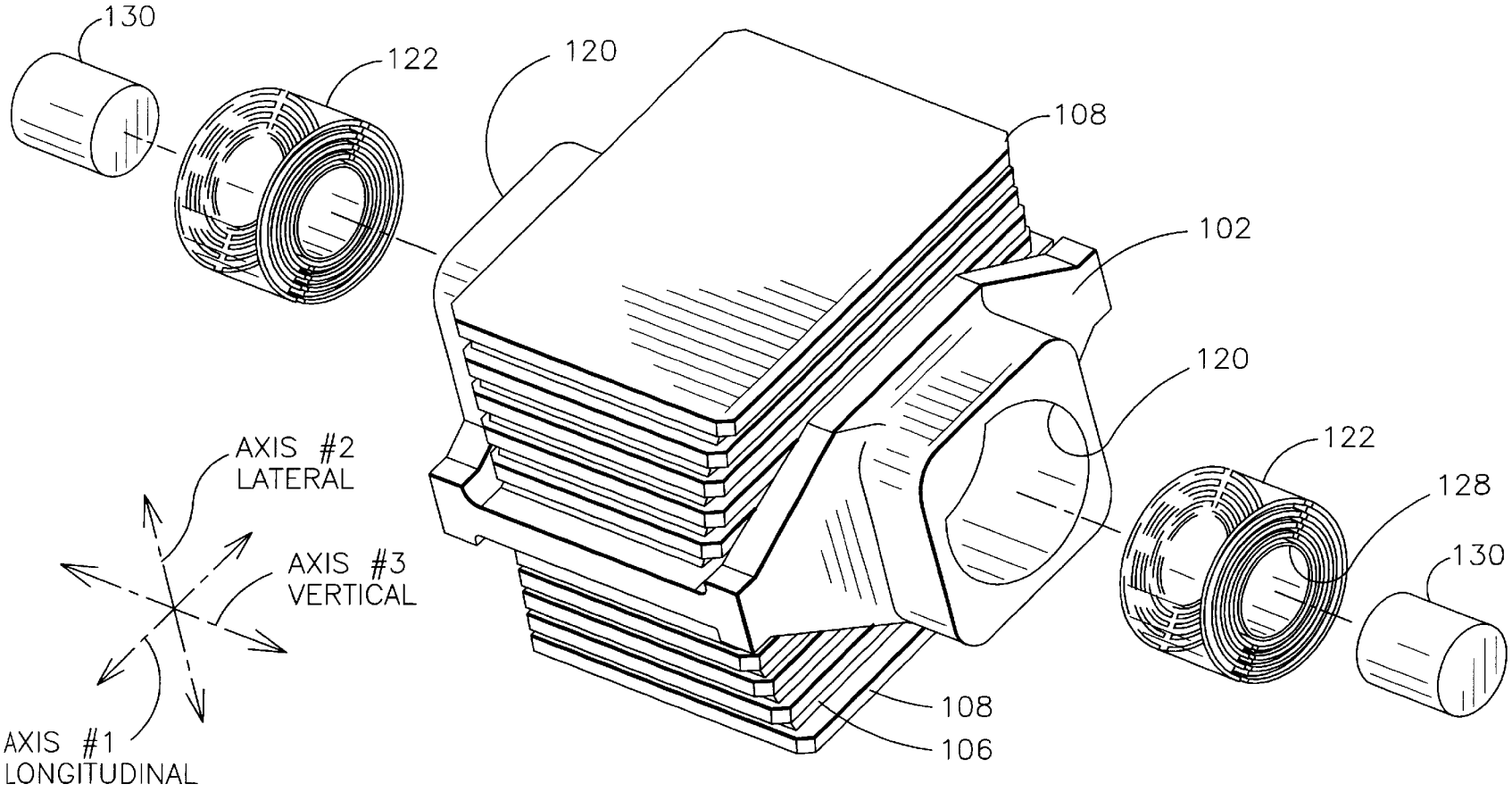
FIG. 10 illustrates an isometric exploded view of the elastomeric bushings, and corresponding pins and prior to assembly into a wing plate of the elastomeric joint.

In another key feature of the invention and as best shown in cross-sectional view in FIG. 8, or in exploded view in FIG. 10, wing plate 102 includes top and bottom bushing-receiving bores 120 for receiving a respective elastomeric bushing 122 that, in one exemplary embodiment as shown in FIG. 9, is made up of a plurality of torsion pads 124, e.g., generally cylindrical pads, that comprise a plurality of alternating layers of resilient material, e.g., natural or synthetic rubber, and nonexetensible material, e.g., metal shims 126. The housing of bushing 122 has an outer diameter dimensioned to provide a relatively tight interference fit with the corresponding bushing-receiving bore. However, to better ensure the tightness of the fit, a suitable bonding polymer, such as Loctite, may be applied during assembly between the mating metal surfaces of the bushing and the bushing-receiving bore. Each bushing defines a pin-receiving bore 128 for receiving a pin 130 respectively received by respective openings 132 (FIG. 5) provided at the top and bottom fork prongs. The pin is dimensioned to have a diameter that provides a tight interference fit with the pin-receiving bore and the fork openings. As suggested above, the tightness of the fit between the pin and any mating metal surfaces may be enhanced through application of Loctite bonding polymer between such surfaces. It will be now appreciated by those skilled in the art that the elastomeric bushing of the present invention is configured to provide a relatively low rotational stiffness that enables large rotational or torsional displacement. Conversely, for avoiding radial displacements, the bushing is configured to provide relatively large radial stiffness. By way of example, at least one one radially extending slot, e.g., slot 140 (FIG. 9), is provided in the torsion pads to enable compressively preloading the bushings against the surfaces that define the respective bushing-receiving bores. Further, it will be appreciated that providing relatively low longitudinal or axial stiffness in the torsion pads allows to maintain low reaction forces on the pins received by the bushings and this would result in longer life of the joint. In one exemplary embodiment, a pair of mutually opposite radially extending slots, e.g., slot pair 140 and 142, aligned generally parallel relative to the longitudinal axis is provided to enable compressive pre-loading of the torsion pads against the surfaces that define the bushing-receiving bores. This pre-compression about the center of the bushing is believed to enhance load transfer ability along the radial direction of the bushing.

Figure 6:
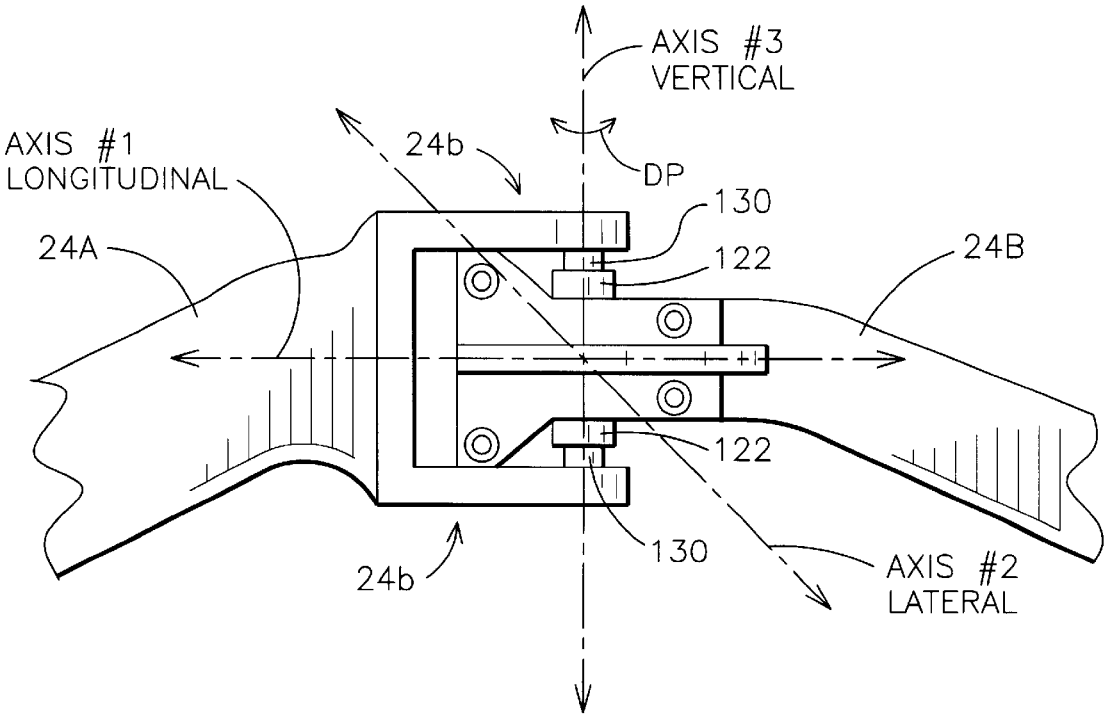
FIG. 6 is a side view of the elastomeric joint of FIG. 4 illustrating the coupling of top and bottom pins to respective top and bottom forked prongs in one of the reaction arms.

As shown in FIG. 6 for example, since each pin 130 is fixedly mounted to a corresponding fork opening, e.g., opening 132 (FIG. 5), its longitudinal movement is constrained therewith while the elastomeric bushing allows differential pivotal movement Dp without any metal-to-metal wear. As suggested above, the cover plate 110 (FIG. 5) clamps the shear pads affixed to wing plate 102 against the back plate 112 in a sandwich arrangement by compressing the shear pads 106 on opposite sides thereof. Differential longitudinal movement Dl between the adjoining ends 24*b* is provided within a suitable useful range by shearing of the elastomeric pads 106 upon relative longitudinal movement between the wing plate 102 and the bracket 98. As the adjoining reaction arms 24A, 24B move inboard or outboard together, the corresponding differential pivotal movement Dp therebetween is accommodated by rotation of the wing plate 102 relative to the fork 96 due to the top and bottom elastomeric bushing without any metal-to-metal wear, and the differential longitudinal movement Dl is accommodated by shearing movement of the shear pads 106. In this way, the required differential movement between the distal ends 24*b* of the adjoining reaction arms 24A, 24B and 24C, 24D is effected for allowing self-steering operation of the linkage. Since the shear pads 106 are resiliently distorted during differential longitudinal movement between the distal ends of the reaction arms 24, an inherent resilient restoring force is created. Similarly, during differential pivotal movement of the distal ends of the reaction arms, resilient distortion of the torsion pads would create a resilient restoring force.

Since the joint 100 must suitably carry the lateral reaction loads Rf, Rr between the adjoining reaction arms, it is desirable that the shear pads 106 be substantially stiff in compression for minimizing differential lateral movement between the adjoining reaction arms for obtaining substantially equal but opposite yaw of the end axles 18A, 18B. As suggested above, in one exemplary embodiment, the construction of the joint shear pads comprises a plurality of alternating layers of metal shims and elastomeric material, such as natural or synthetic rubber, bonded together for increasing compressive stiffness thereof while permitting resilient shearing movements therebetween. The shear pads 106 may therefore be substantially stiff in compression for minimizing differential lateral movement between the fork 96 and bracket 98 for improving hunting speed, but are sufficiently resilient or flexible in shear for allowing the required differential longitudinal movement Dl, and, in cooperation with the top and bottom bushings, for allowing the required pivotal movement Dp. It will be appreciated that the foregoing embodiment is further configurable to provide an additional degree of freedom since the joint may be made substantially resilient or flexible in shear for allowing vertical movement. Although during operation of the truck, the coupling of the adjoining reaction arms does not demand any substantial loads along the vertical axis V (FIG. 8), it will be appreciated that the joint of the present invention is configurable to provide such additional degree of freedom in applications where vertical displacement may be desirable. Moreover, even in the present application, having such additional degree of freedom may be helpful during assembly of the joint onto the truck. In one exemplary embodiment, the joint 100 may include one or more shim plates, e.g., shim plate 109 in FIG. 5, disposed in abutting contact with the shear pads and the cover plate, the back plate or both. Such shim plates may be used for aligning the respective pin-receiving bores of the top and bottom bushings with the corresponding pins 130, and for adjusting, the spacing between the centrally disposed base plate, and the mutually opposite cover and back plates so as to adjust the level of pre-loading provided to the shear pads.

It will be understood that the specific embodiment of the invention shown and described herein is exemplary only. Numerous variations, changes, substitutions and equivalents will now occur to those skilled in the art without departing from the spirit and scope of the present invention. Accordingly, it is intended that all subject matter described herein and shown in the accompanying drawings be regarded as illustrative only and not in a limiting sense and that the scope of the invention be solely determined by the appended claims.

What is claimed is:

1. An assembly for coupling adjoining ends of a pair of reaction arms in a steering linkage of a railway truck, said assembly comprising:

a joint between the reaction arms comprising a rigid frame;

an elastomeric bushing secured at one portion thereof to the frame and to one of the arms at another portion thereof; and a stack of elastomeric pads secured at one portion thereof to the frame and at another portion thereof to the other arm, with the frame being free of any direct connection or engagement with either arm, wherein pivotal movement between the adjoining ends of the arms is accommodated and resiliently resisted by the elastomeric bushing, and further wherein relative longitudinal movement between the adjoining ends of the arms is accommodated and resiliently resisted by the stack of elastomeric pads, with the frame being free of any direct connection or engagement with either arm, whereby relative longitudinal and pivotal movement between the adjoining ends of the arms is accommodated and resiliently resisted by deformation of the elastomeric bushing and stacks of pads, thus avoiding direct frictional engagement between the arms or between the arms and the frame, or both, subjecting these components to wear.

2. The assembly of claim 1 wherein said joint further allows, without direct frictional engagement, differential vertical movement between said adjoining ends.

3. The assembly of claim 1 wherein said joint comprises a wing plate including a base plate generally extending along a longitudinal axis and generally perpendicular to a lateral axis, said wing plate further including mutually opposite top and bottom bushing-receiving bores co-axially aligned relative to a vertical axis perpendicular to said lateral and longitudinal axes.

4. The assembly of claim 3 wherein said elastomeric pads are affixed on mutually opposite sides of said base plate, said plurality of pads stacked generally perpendicular to said lateral axis.

5. The assembly of claim 4 wherein said elastomeric bushing comprises top and bottom elastomeric bushings received by said respective bushing-receiving bores, each elastomeric bushing comprising a plurality of generally cylindrical pads including at least one radially extending slot configured to enable compression of said cylindrical pads against the surfaces defining said bushing-receiving bores.

6. The assembly of claim 5 wherein each elastomeric bushing includes a respective pin-receiving bore.

7. The assembly of claim 6 each of said elastomeric pads and generally cylindrical pads comprises a plurality of alternating layers of resilient and nonextensible materials.

8. The assembly of claim 7 further comprising a cover plate positioned to compress the plurality of elastomeric pads on each side of said base plate between said cover plate and a back section of a bracket.

9. The assembly of claim 8 further comprising top and bottom pins received by said pin-receiving bores.

10. The assembly of claim 8 further comprising at least a pair of shim plates respectively interposed between the cover plate, the back section of the bracket and corresponding elastomeric pads, the thickness of said shim plate pair being determinative of the level of compression applied to the elastomeric pads.

11. The assembly of claim 8 further comprising at least one shim plate interposed between the cover plate and the corresponding elastomeric pads, the thickness of said shim plate being determinative of the level of compression applied to the pads.

12. The assembly of claim 8 further comprising at least one shim plate interposed between the back section of the bracket and the corresponding elastomeric pads, the thickness of said shim plate being determinative of the level of compression applied to the elastomeric pads.

13. A method of assembling an elastomeric joint, said method comprising:

providing a wing plate including a base plate generally extending along a first axis and generally perpendicular to a second axis, said wing plate further providing mutually opposite first and second bushing-receiving bores co-axially aligned relative to a third axis perpendicular to said first and second axes;

affixing a plurality of elastomeric shear pads on mutually opposite sides of said base plate, said plurality of shear pads stacked generally perpendicular to said second axis; and interferingly fitting top and bottom elastomeric bushings in said respective bushing-receiving bores, each elastomeric bushing comprising a plurality of torsion pads and including a respective pin-receiving bore, each of said shear pads and torsion pads comprising a plurality of alternating layers of resilient and nonextensible materials;

compressively preloading said shear pads to provide stiff opposition to forces along said second axis, while providing relatively low stiffness along said first axis and/or along said third axis; and compressively preloading said torsion pads to enable pivotal movement about said third axis while providing stiff opposition to radial forces on said torsion pads.

14. An elastomeric joint for coupling adjoining ends of a pair of reaction arms used in a steering linkage of a railway truck, said joint comprising:

a wing plate including a base plate generally extending along a first axis and generally perpendicular to a second axis, said wing plate further including mutually opposite first and second bushing-receiving bores co-axially aligned relative to a third axis perpendicular to said first and second axes;

a plurality of elastomeric shear pads affixed on mutually opposite sides of said base plate, said plurality of shear pads stacked generally perpendicular to said second axis; and top and bottom elastomeric bushings received by said respective bushing-receiving bores, each elastomeric bushing comprising a plurality of torsion pads and including a respective pin-receiving bore, each of said shear pads and torsion pads comprising a plurality of alternating layers of resilient and nonextensible materials, wherein said shear pads are compressed to provide stiff opposition to forces along said second axis, while accommodating differential displacement along said first axis and along said third axis, and wherein said torsion pads are compressed to enable pivotal movement about said third axis while providing stiff opposition to radial forces on said torsion pads.

15. The joint of claim 14 wherein said torsion pads comprise generally cylindrical pads and include at least one radially extending slot configured to enable compressive preloading of said torsion pads against the surfaces defining said bushing-receiving bores.

16. The joint of claim 14 wherein said torsion pads include a pair of mutually opposite radially extending slots configured to enable compressive preloading of said torsion pads against the surfaces defining said bushing-receiving bores.

17. The joint of claim 16 wherein said pair of radially extending slots are in alignment relative to said first axis.

18. An assembly for coupling adjoining ends of a pair of reaction arms used in a steering linkage of a railway truck, one of said reaction arms ends comprising a fork having a top prong and a bottom prong, the other one of said reaction arms ends comprising a bracket received by said fork, said assembly comprising:

an elastomeric joint supported by said bracket, said joint comprising:

a wing plate including a base plate generally extending along a longitudinal axis and generally perpendicular to a lateral axis, said wing plate further including mutually opposite top and bottom bushing-receiving bores co-axially aligned relative to a vertical axis perpendicular to said lateral and longitudinal axes;

a plurality of elastomeric shear pads affixed on mutually opposite sides of said base plate, said plurality of shear pads stacked generally perpendicular to said lateral axis;

top and bottom elastomeric bushings received by said respective bushing-receiving bores, each elastomeric bushing comprising a plurality of torsion pads including at least one radially extending slot configured to enable compression of said torsion pads against the surfaces defining said bushing-receiving bores, each elastomeric bushing including a respective pin-receiving bore, each of said shear pads and torsion pads comprising a plurality of alternating layers of resilient and nonextensible materials;

a cover plate affixable to said bracket to compress the plurality of shear pads on each side of said base plate between said cover plate and a back section of the. bracket; and top and bottom pins received by said pin-receiving bores, said pins being fixedly connected to respective openings in the top and bottom prongs, wherein said shear pads provide stiff opposition to forces along said lateral axis, while accommodating differential displacement along said longitudinal axis, and wherein said elastomeric bushings enable relative pivotal movement of the reactions arms about said vertical axis while providing stiff opposition to radial forces on said torsion pads.

19. A method for coupling adjoining ends of a pair of reaction arms used in a steering linkage of a railway truck, one of said reaction arms ends comprising a fork having a top prong and a bottom prong, the other one of said reaction arms ends comprising a bracket received by said fork, said method comprising:

providing an elastomeric joint in said bracket, said joint comprising a multi-degree of freedom elastomeric joint including respective pluralities of shear and torsion pads that in frictionless engagement allows differential longitudinal and pivotal movement between said adjoining ends; and affixing a cover plate to said bracket to compress the plurality of shear pads on each side of a base plate between said cover plate and a back section of the bracket, wherein said shear pads provide stiff opposition to forces along said lateral axis, while accommodating differential displacement along said longitudinal axis, and wherein said torsion pads enable relative pivotal movement of the reactions arms about said vertical axis while providing stiff opposition to radial forces on said torsion pads.

* * * * *